US006848747B1

(12) United States Patent
Robinson

(10) Patent No.: US 6,848,747 B1
(45) Date of Patent: Feb. 1, 2005

(54) ARTICLE OF FURNITURE FORMED FROM SLOTTED PLANAR MEMBERS

(76) Inventor: Dina M. Robinson, 520 SE. 52nd Ave., Portland, OR (US) 97215

( * ) Notice: Subject to any disclaimer, the term of this patent is extended or adjusted under 35 U.S.C. 154(b) by 0 days.

(21) Appl. No.: 10/366,309

(22) Filed: Feb. 12, 2003

Related U.S. Application Data

(60) Provisional application No. 60/440,992, filed on Jan. 17, 2003.

(51) Int. Cl.[7] ..... A47C 4/00

(52) U.S. Cl. ..... 297/440.13; 297/440.1; 297/440.14; 297/258; 446/479; 446/482

(58) Field of Search ..... 297/440.12, 440.13, 297/440.14, 440.1; 446/479, 482

(56) References Cited

U.S. PATENT DOCUMENTS

| | | | | | |
|---|---|---|---|---|---|
| 1,369,093 | A | * | 2/1921 | Fisher | 446/97 |
| 2,479,086 | A | * | 8/1949 | Silverman | 297/440.13 |
| 2,920,683 | A | * | 1/1960 | Moster | 297/313 |
| D204,399 | S | | 4/1966 | Horowitz | |
| 4,052,100 | A | | 10/1977 | Nikitis et al. | |
| 4,225,180 | A | * | 9/1980 | Gillis | 297/271.5 |
| 4,593,950 | A | * | 6/1986 | Infanti | 297/3 |
| D295,432 | S | | 4/1988 | Baranek | |
| D311,429 | S | | 10/1990 | Steele | |
| 5,000,514 | A | * | 3/1991 | Hanson | 297/440.13 |
| 5,605,378 | A | * | 2/1997 | Oyediran | 297/440.13 |
| 5,795,027 | A | * | 8/1998 | Howard et al. | 297/440.12 |
| 5,803,548 | A | * | 9/1998 | Battle | 297/440.13 |
| 5,992,938 | A | * | 11/1999 | Jones | 297/440.13 |
| D425,576 | S | | 5/2000 | Michaelson | |
| D434,577 | S | | 12/2000 | Marek | |
| D436,144 | S | | 1/2001 | Michaelson | |
| D436,459 | S | | 1/2001 | Watson et al. | |
| D436,636 | S | | 1/2001 | Joseph-Turner | |
| 6,224,159 | B1 | | 5/2001 | Perry | |
| 6,247,754 | B1 | * | 6/2001 | Vanderaue et al. | 297/440.13 |
| 6,619,749 | B2 | * | 9/2003 | Willy | 297/440.13 |

* cited by examiner

*Primary Examiner*—Peter M. Cuomo
*Assistant Examiner*—Erika Garrett
(74) *Attorney, Agent, or Firm*—Ipsolon LLP

(57) ABSTRACT

An article of furniture formed from a plurality of slotted substantially planar members joined together at their respective slots is disclosed. The planar members can be formed into a chair, a bench, a bed, or a table. In a preferred embodiment, the furniture is doll furniture, and the chair can also include a slotted substantially planar desk member or tray member, thereby allowing the chair to serve as a desk or highchair. The seat of the chair and the seats of the bench preferably include a substantially arcuate protrusion sized so that a doll's legs straddle it. Accordingly, dolls with at least a pair of legs extending therefrom and having no pivoting leg joints, only pivoting hip joints, or pivoting knee joints and pivoting hip joints can all appear to be sitting in the chair simply by straddling the arcuate protrusion. The planar members can include surfaces adapted to allow the user to apply desirable surface ornamentation thereon. Accordingly, the article of furniture can be sold as a craft kit wherein the customer may personalize their article of furniture.

10 Claims, 7 Drawing Sheets

20
60
30
22
56
54
42
46
78b
22
72
74
78a
58
44
50
66

60
22
85
46
78b
70
52
80b
72
78a
80a
74
54
42
48
50
64
84
62
22
44
68
66

60
56
22
52
54
42
58
48
50
70
22
46
78b
78a
80a
80b
74
64
62
22
68
44
66

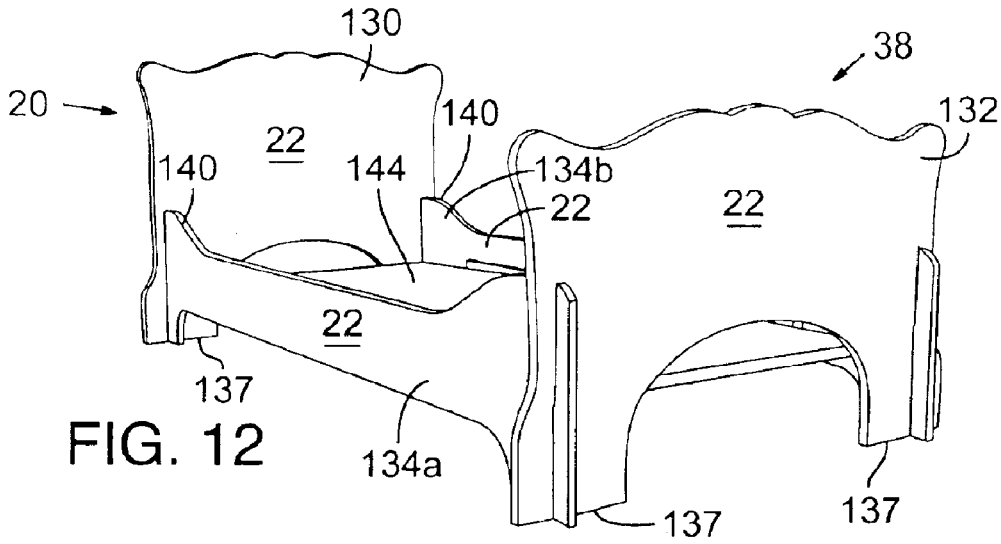
FIG. 12
FIG. 13
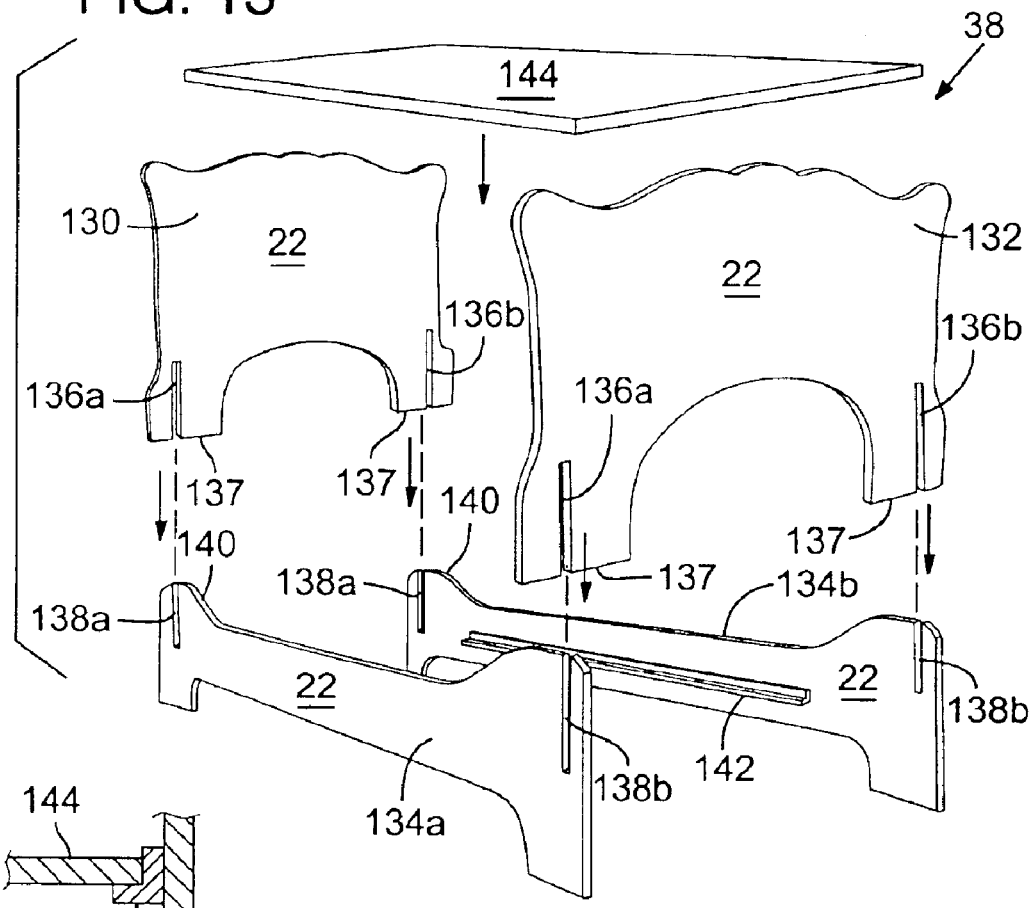
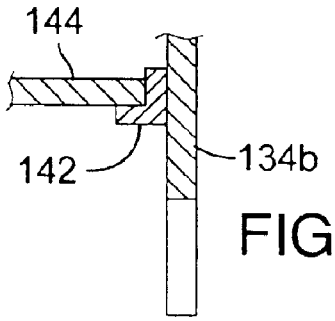
FIG. 14

ARTICLE OF FURNITURE FORMED FROM SLOTTED PLANAR MEMBERS

CROSS-REFERENCE TO RELATED APPLICATIONS

This application claims priority to U.S. Provisional Patent Application Ser. No. 60/440,992, filed on Jan. 17, 2003.

FIELD OF THE INVENTION

The present invention relates to an article of furniture. In particular, the article of furniture is formed from a plurality of slotted, planar members operably secured together at their respective slots.

BACKGROUND OF THE INVENTION

Furniture, such as chairs, benches, beds and tables, are widely known and used.

It is desirable under some circumstances for the furniture to be easily assembled and dissembled, strong, durable, and aesthetically pleasing during use, but also compact and portable when not in use. For example, children and collectors often prefer to display their dolls resting on doll furniture. Frequently, these children and collectors must transport a large quantity of dolls and their respective doll furniture. Accordingly, it is desirable for the doll furniture to fit within a small area when not in use, such as in a doll case with the doll, but still be easily assembled when needed.

Conventional doll furniture has several drawbacks. It is expensive, and can be bulky, non-aesthetically pleasing, or difficult to assemble and disassemble.

In addition, many dolls do not have pivoting knee joints. Rather, these dolls' legs' pivot only at the hip area or they do not pivot at all. These types of dolls do not "sit" in natural appearing positions when seated on traditional doll chairs and benches. For example, with the rear of such dolls fully seated on the seat of a traditional doll chair, the legs of the doll protrude from the chair substantially parallel to the floor such that the dolls' feet are positioned unnaturally above the floor at about the chair seat's height. Alternatively, the doll is kept in a substantially standing position and leaned against the chair so that its feet rest on the ground, but the rear of the doll does not occupy the seat of the chair. Neither of these uses of the doll chair provide an aesthetically pleasing appearance that the doll is actually seated correctly in the chair.

These principles of having a strong, durable, and economical, aesthetically pleasing article of furniture that is also easy to transport, assemble, and disassemble are not limited to doll furniture. They apply equally well to furniture sized and aimed for human use.

SUMMARY OF THE INVENTION

Accordingly, despite the benefits of the known furniture, there remains a need for a simple, cost effective, strong, durable, and easy to assemble and disassemble, article of furniture. In addition to other benefits that will become apparent in the following disclosure, the present invention fulfills these needs.

The present invention is an article of furniture formed from a plurality of slotted substantially planar members joined together at their respective slots. The planar members can be formed into a chair, a bench, a bed, or a table. In a preferred embodiment, the furniture is doll furniture, and the chair can also include a slotted substantially planar desk member or tray member, thereby allowing the chair to serve as a desk or highchair. The seat of the chair and the seats of the bench preferably include a substantially arcuate protrusion sized so that a dolls' legs straddle it. Accordingly, all dolls, including those having no pivoting leg joints or only a pivoting hip joint with no pivoting knee joints can appear to be "sitting" in the chair simply by straddling the arcuate protrusion.

The planar members can include surfaces adapted to allow the user to apply desirable surface ornamentation thereon. Accordingly, the article of furniture can be sold as a craft kit wherein the customer may personalize their article of furniture.

Additional objects and advantages of the present invention will be apparent from the detailed description of the preferred embodiment thereof, which proceeds with reference to the accompanying drawings.

BRIEF DESCRIPTION OF THE DRAWINGS

FIG. 12 is an isometric view of a bed in accordance with an embodiment of the present invention.

FIG. 13 is an exploded, isometric view of the bed of FIG. 12.

FIG. 14 is an enlarged, view of a possible connection between components of the bed of FIG. 12.

DETAILED DESCRIPTION OF PREFERRED EMBODIMENTS

Figure 15:
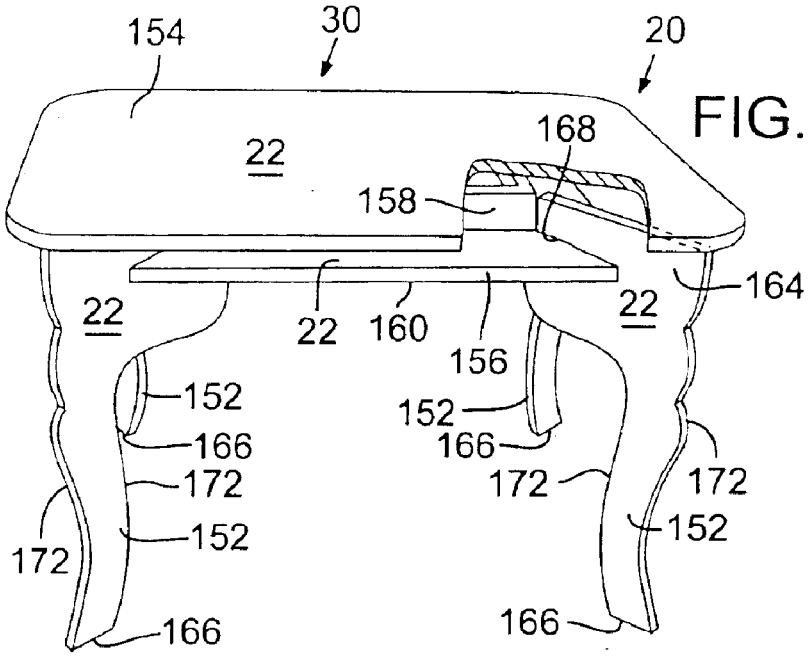
FIG. 15 is an isometric view of a table in accordance with an embodiment of the present invention with a portion of the table top cut-away to show detail therein.
Figure 16:
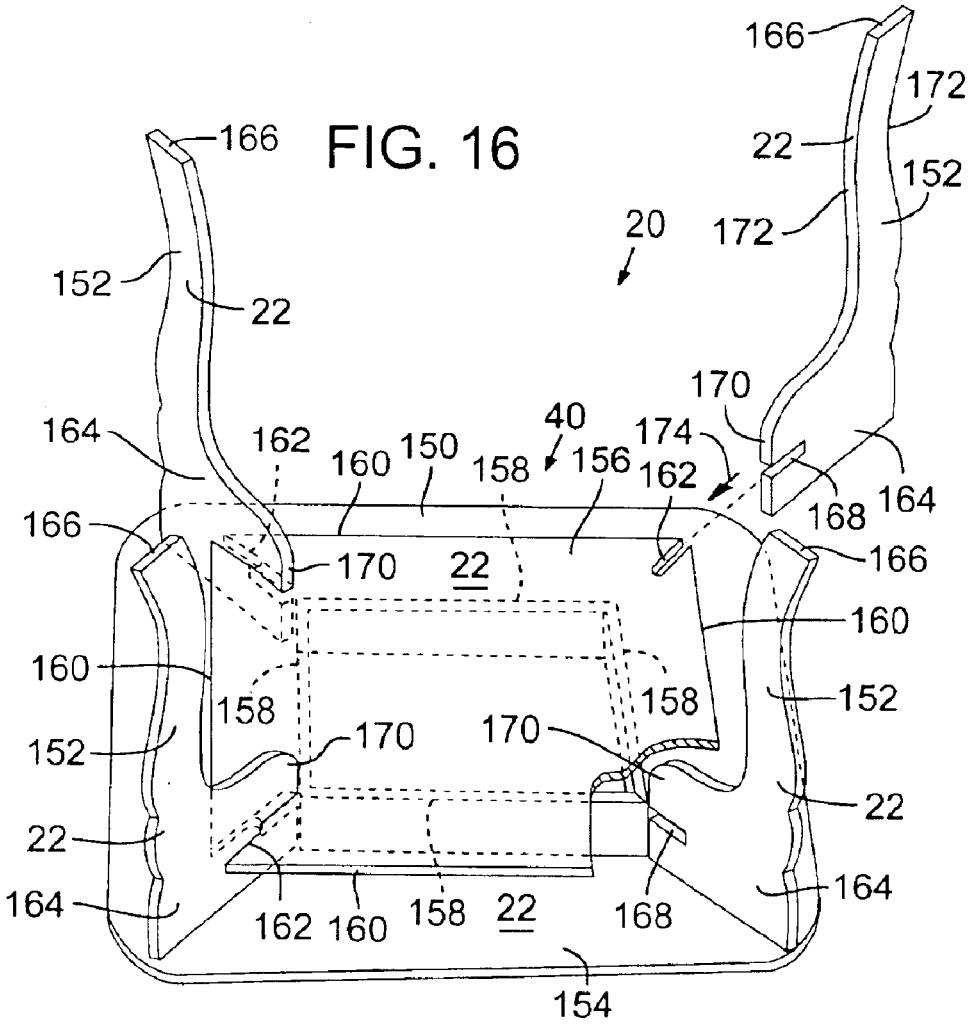
FIG. 16 is a partially exploded, isometric view of the table of FIG. 15 showing a possible connection between planar components forming the table.

A simple, cost effective, easy to assemble and disassemble article of furniture 20 formed from a plurality of slotted, planar members 22 that are secured together at their respective slots is disclosed in FIGS. 1–16. The article of furniture 20 formed from these slotted planar members can include a chair 30 (FIGS. 1–5), a desk 32 (FIGS. 6–7), a highchair 34 (FIGS. 8–9), a bench 36 (FIGS. 10–11), a bed 38 (FIGS. 12–13), and a table 40 (FIGS. 15–16). Each of these embodiments is discussed in greater detail below.

A. Chair

Figure 1:
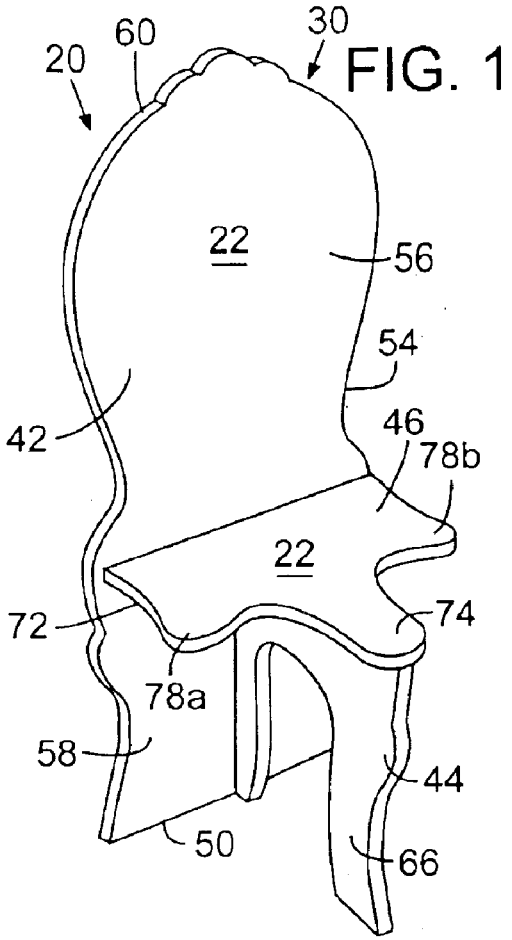
FIG. 1 is an isometric front view of a fully assembled chair in accordance with an embodiment of the present invention.
Figure 2:
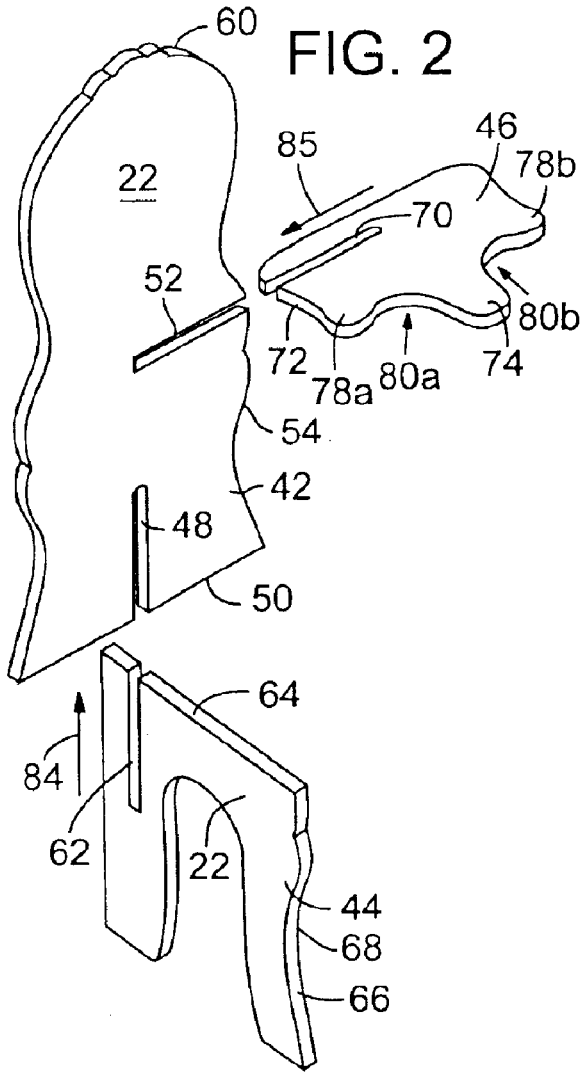
FIG. 2 is an exploded, isometric view of the chair of FIG. 1.
Figure 3:
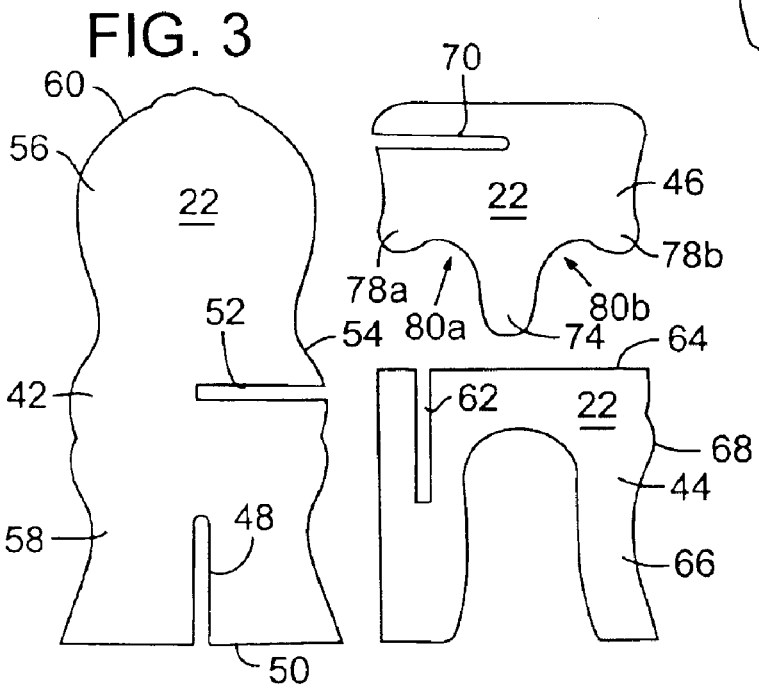
FIG. 3 is a front view of the components used to form the chair of FIG. 1.

Referring to FIGS. 1–3, a chair 30 formed from the plurality of slotted planar members 22 is disclosed. Preferably, the chair 30 is formed from a substantially planar back member 42, a substantially planar leg member 44, and a substantially planar seat member 46. The planar members 42, 44, 46 are preferably constructed of substantially rigid, durable and aesthetically pleasing materials such as wood, plastic, or the like. The back member 42 preferably includes a first slot 48 extending to a lower edge 50 and aligned substantially vertically and a second slot 52 extending to a side edge 54 and aligned substantially horizontally. The area above the second slot 52 defines a seat back 56 and the area below the second slot 52 defines a leg portion 58 of the chair 30. The outer edge 60 of the back member 42 can include ornamental contours and shapes as shown to make the chair 30 more aesthetically pleasing.

The leg member 44 includes a substantially vertical slot 62 extending to an upper edge 64 of the leg member 44 and positioned and aligned to engage the first slot 48 on the back member 42 as shown in FIG. 2. If desired, the leg member 44 can include a contoured portion thereby defining a forward leg 66. The forward outer edge 68 of the forward leg 66 can be contoured to make the leg member 44 more aesthetically pleasing.

Figure 4:
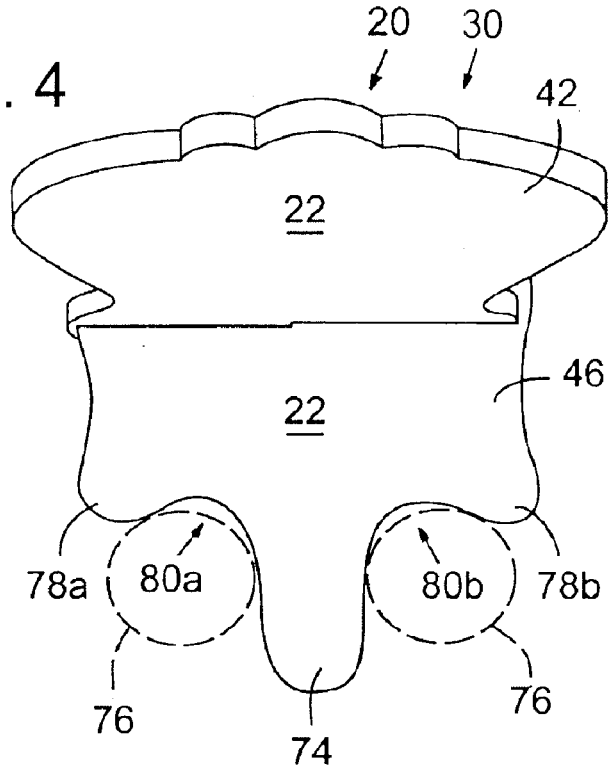
FIG. 4 is a top view of the chair of FIG. 1 showing a possible position of a doll's legs relative to a seat of the chair in accordance with an embodiment of the present invention.

The seat member 46 includes a slot 70 extending to an outer edge 72 of the seat member 46 that is sized and aligned so as to engage the second slot 52 on the back member 42 as shown in FIG. 2. Preferably, the seat member 46 includes a protrusion 74 extending therefrom that is sized to allow a doll's legs 76 to straddle the protrusion 74. More preferably, the protrusion 74 has a smoothly arcuate contour that straddles left and right smoothly arcuate projections 78*a*, 78*b* as best shown in FIG. 3, thereby defining recesses 80*a*, 80*b*. Recesses 80*a*, 80*b* are sized to operably engage the upper leg portion of a doll 82 as best shown in FIG. 4.

A user assembles the chair 30 using these three planar slotted members 42, 44, 46 by aligning the leg member 44 with the back member 42 so that vertical slot 62 operably engages first slot 48, and then sliding the leg member 44 in the direction of arrow 84 (FIG. 2) so that the leg member is positioned relative to the back member 42 as shown in FIG. 1. Then, the user aligns the seat member 46 with the back member 42 such that slot 70 aligns with second slot 52, and then slides the seat member 46 in the direction of arrow 85 (FIG. 2) so that the seat member 46 is positioned relative to the back member 42 as shown in FIG. 1. The chair 30 may be easily disassembled by reversing these steps.

Figure 5:
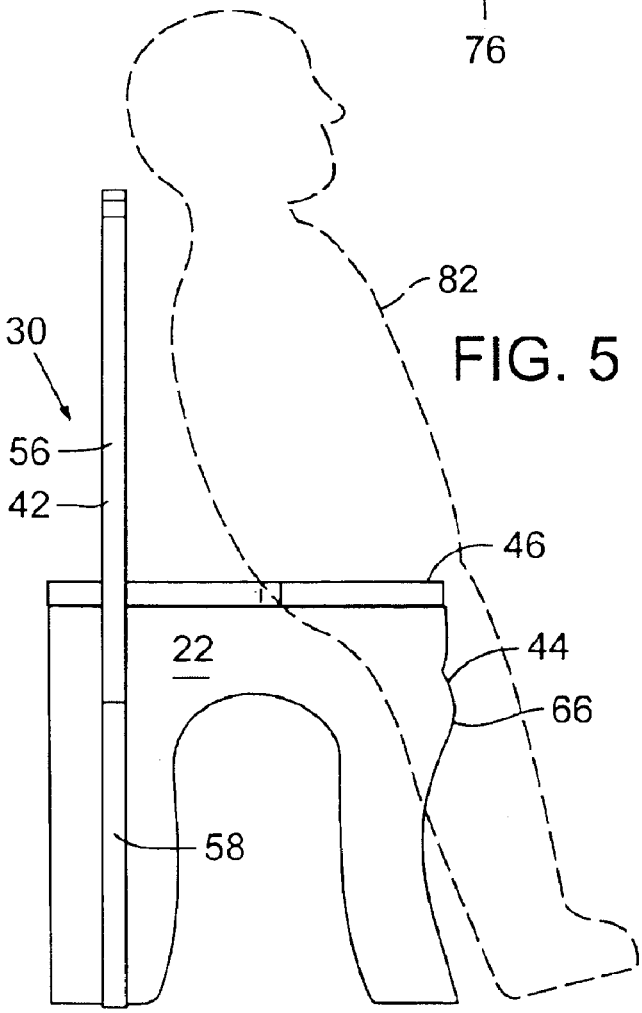
FIG. 5 is a side view of the chair of FIG. 1 showing a possible orientation of a doll relative to the chair in accordance with an embodiment of the present invention.
Figure 6:
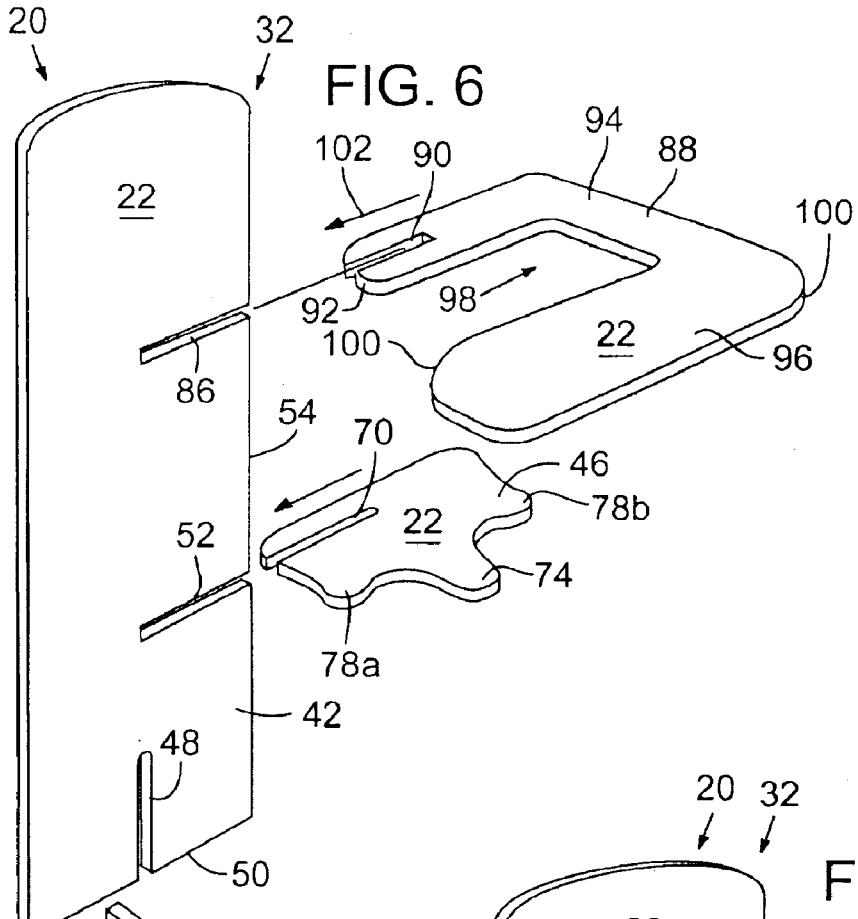
FIG. 6 is an exploded, isometric view of a desk in accordance with an embodiment of the present invention.

With the chair 30 assembled as shown in FIG. 1, a doll 82 may be positioned on the chair as shown in FIG. 5. The doll may have no pivoting leg joints, leg joints that pivot only at the hip, or leg joints that pivot both at the hip and knee. Accordingly, as used throughout this disclosure, the term "doll" collectively refers to objects having these features including a traditional toy that resembles a baby or human and also stuffed animals and the like such as teddy bears that have at least one pair of legs. The doll is positioned on the chair is a quasi-standing position as shown in FIG. 5. However, the doll's legs straddle the protrusion in on the seat as shown in FIG. 6. Accordingly, the doll appears to be sitting on the seat with its feet resting on the ground, thereby providing an aesthetically pleasing position for the doll relative to the chair. The chair also works well with dolls that have articulated knee joints. In such case, the doll sits on the horizontally-planar portion of the seat member 46 with its knees bending so that it's feet are directed toward the ground.

B. Desk

Figure 7:
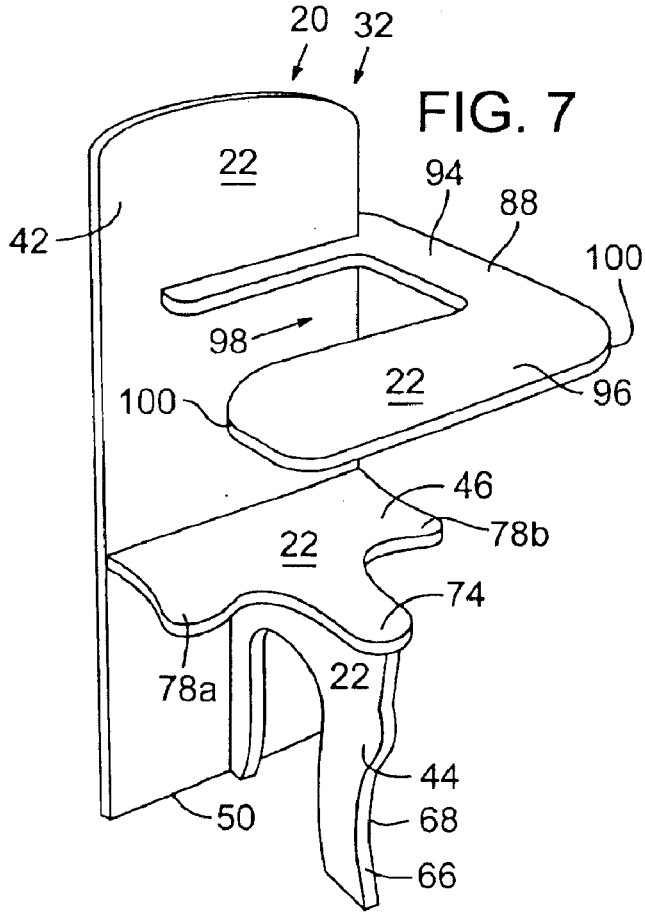
FIG. 7 is an isometric view of the fully assembled desk of FIG. 6.

Referring to FIGS. 6 & 7, the chair 30 of the earlier embodiment can be readily adapted to form a desk 32. For example, the back, leg, and seat members 42, 44, 46 can form a chair of the desk 32 as shown using the structures and orientation of the previously disclosed chair embodiment. In addition, the back member 42 can include a third slot 86 extending to a side edge 54 of the back member 42 and positioned above the second slot 52 as shown in FIG. 6.

A substantially planar desk member 88 includes a slot 90 extending to an outer edge 92 and sized to operably engage the third slot 86 on the back member 42 as shown. The desk member 88 includes a side portion 94 with a desk portion 96 extending therefrom defining an opening 98 that allows the desk member 88 to be positioned in front of a doll seating in the chair. The edges 100 of the desk portion can be contoured so as to provide an ascetically pleasing surface.

To use the desk, a user assembles the chair portion and seats a doll on the chair as previously described. The user then slides the desk member 88 in the direction of arrow 102 (FIG. 6) so as to engage slot 86 on the back member 42. The torso of the doll is positioned at opening 98 as the desk member 88 is slid into position in front of the doll. The desk 32 may be easily disassembled by reversing these steps.

C. Highchair

Figure 8:
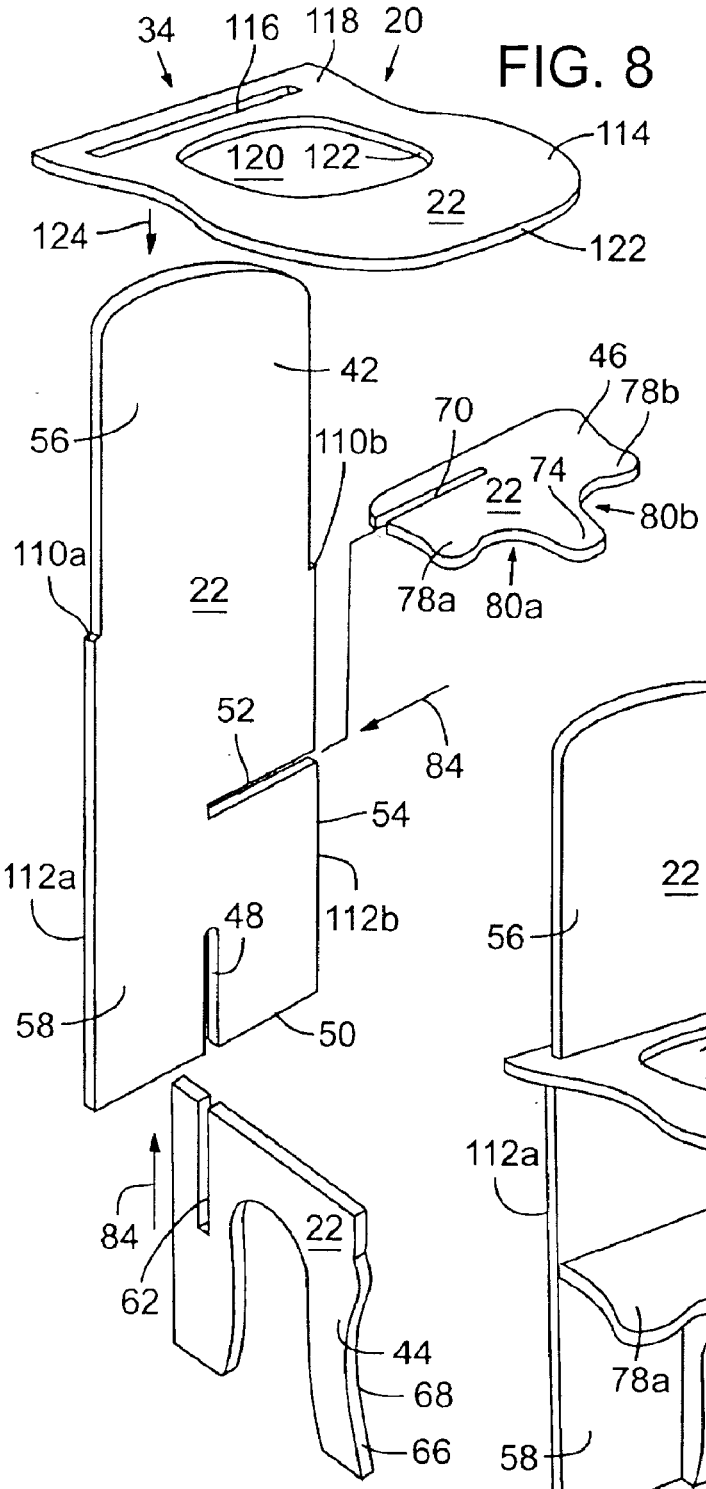
FIG. 8 is an exploded, isometric view of a highchair in accordance with an embodiment of the present invention.
Figure 9:
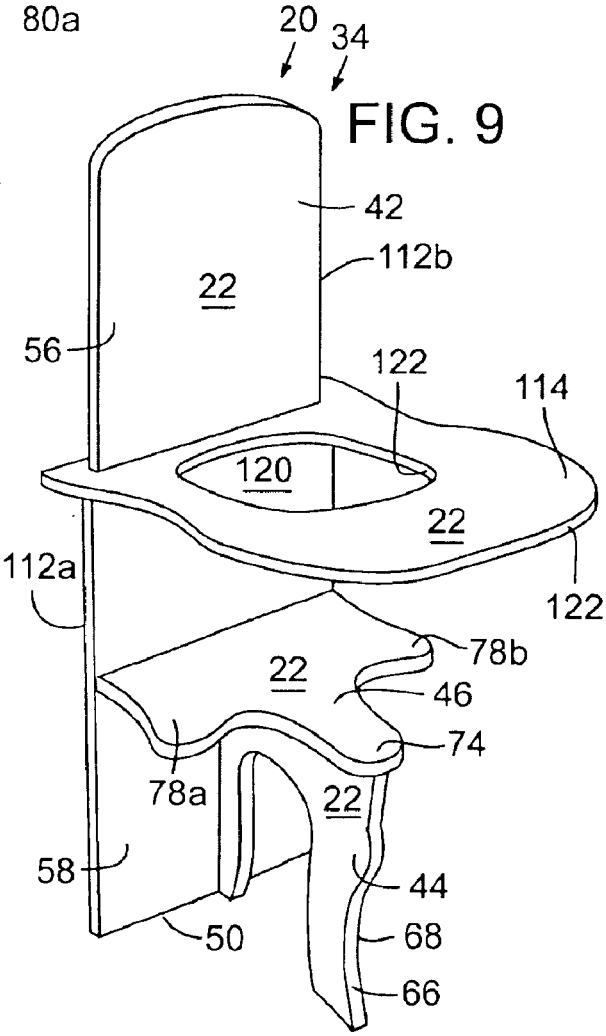
FIG. 9 is an isometric view of the fully assembled highchair of FIG. 8

Referring to FIGS. 8 & 9, the chair 30 of the earlier embodiment can be readily adapted to form a highchair 34. For example, the back, leg, and seat members 42, 44, 46 can form the chair portion of a highchair 34 as shown using the structure and orientation of the previously disclosed chair embodiment. In addition, the back member 42 can include parallelly aligned lips 110*a*, 110*b* along the left and right sides 112*a*, 112*b* as best shown in FIG. 8.

A substantially planar tray member 114 includes a slot 116 fully contained within a back portion 118 of the tray member 114. The slot 116 is sized to operably engage the back member 42 so as to rest on the lips 110*a*, 110*b* of the back member 42 as shown in FIG. 8. An opening 120 is positioned in the tray member and sized to operably receive the head and torso of a doll sitting the chair therethrough. The edges 122 of the tray member can be contoured so as to provide an ascetically pleasing surface.

To use the highchair 34, a user assembles the chair portion and seats a doll on the chair as previously described. The user then slides the tray member 114 in the direction of arrow 124 (FIG. 8) so as to engage slot 116 on the 42. The head and torso of the doll is positioned through the opening 120 as the tray member 114 is lowered into position. The highchair 34 may be easily disassembled by reversing this process.

D. Bench

Figure 10:
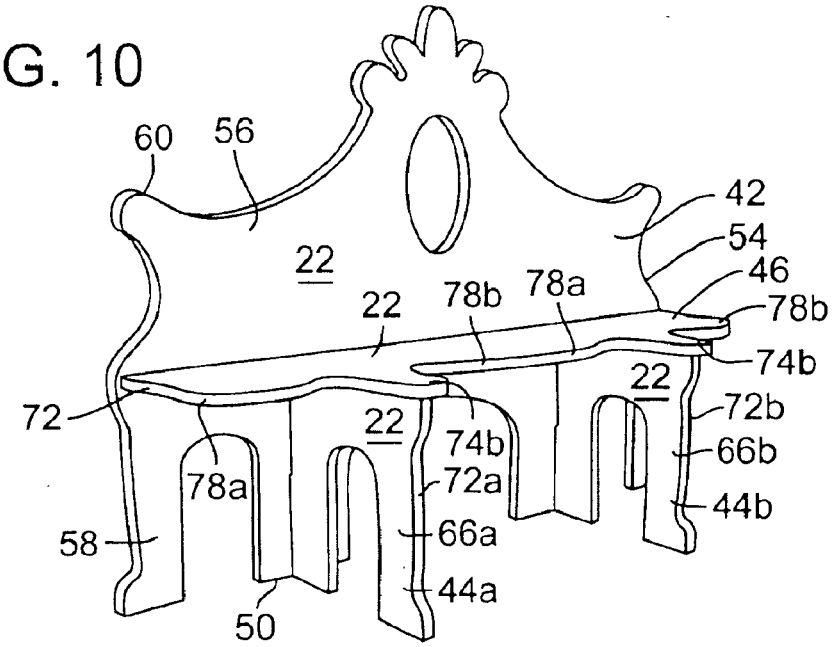
FIG. 10 is an isometric view of a bench in accordance with an embodiment of the present invention.
Figure 11:
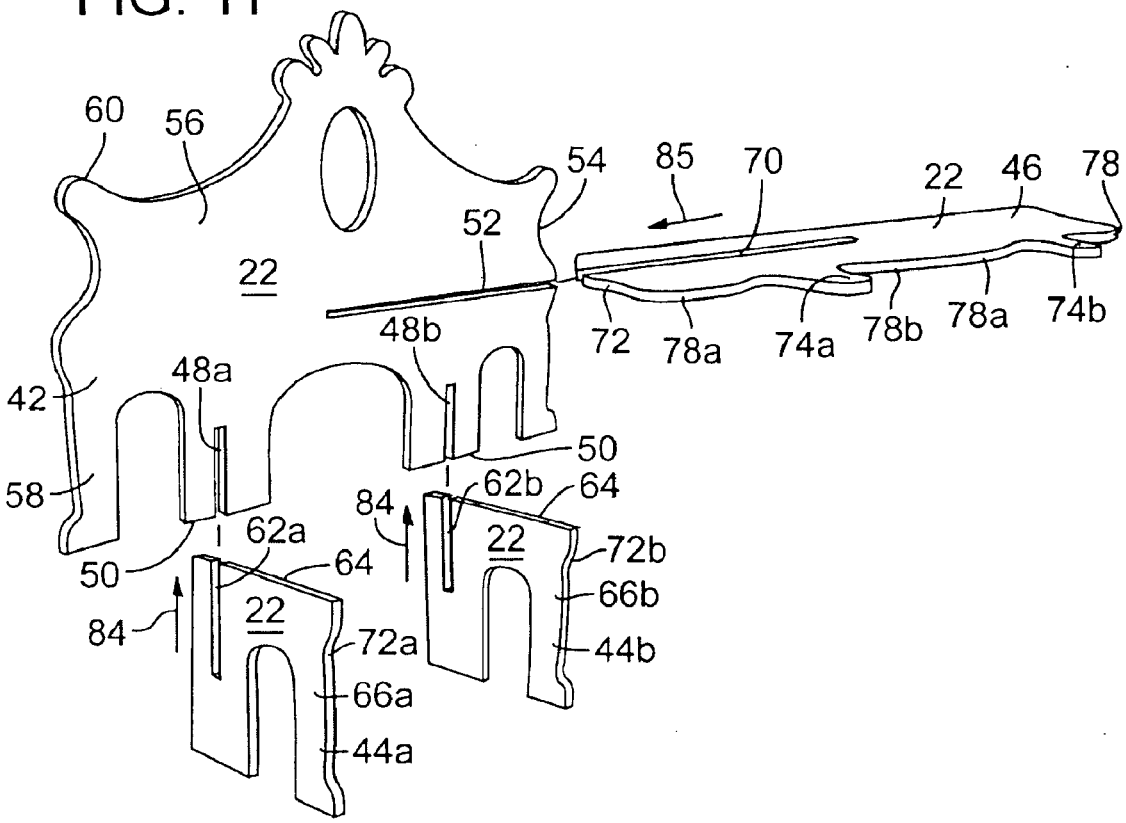
FIG. 11 is an exploded, isometric view of the bench of FIG. 10.

Referring to FIGS. 10 & 11, a bench 36 formed from the plurality of slotted planar members 22 is disclosed. Preferably, the bench 36 is formed from a substantially planar back member 42, two substantially planar leg members 44*a*, 44*b*, and a substantially planar seat member 46. The back member 42 preferably includes a pair of spaced-apart and parallelly aligned first slots 48*a*, 48*b* extending to a lower edge 50 and aligned substantially vertically and a second slot 52 extending to a side edge 54 and aligned substantially horizontally. The area above the second slot defines a seat back 56 and the area below the second slot defines a leg portion 58 of the bench 36. The outer edge 60 of the back member 42 can include ornamental contours and shapes as shown to make the bench 36 more aesthetically pleasing.

The leg members 44*a*, 44*b* each include a substantially vertical slot 62*a*, 62*b*, respectively, extending to an upper edge 64 of the leg member 44*a*, 44*b* and positioned and aligned to engage a respective slot 48*a*, 48*b* of the first slots 48*a*, 48*b* on the back member as shown in FIG. 11. If desired, each leg member 44*a*, 44*b* can include a contoured portion thereby defining a forward leg 66*a*, 66*b*. The forward outer edge 72*a*, 72*b* of each forward leg can be contoured to make each leg member 44*a*, 444*b* more aesthetically pleasing.

The seat member 46 includes a slot extending to an outer edge 72 of the seat portion that is sized and aligned so as to engage the second slot 52 on the back member 42 as shown in FIG. 2. Preferably, the seat member 46 includes a plurality of spaced-apart protrusions 74*a*, 74*b* extending therefrom. Each protrusion 74*a*, 74*b* is sized to allow a doll's legs to straddle the protrusion 74*a*, 74*b*. More preferably, each protrusion has a smoothly arcuate contour that straddles left and right smoothly arcuate projections 78*a*, 78*b* as best shown in FIG. 10, thereby defining recesses. The recesses are sized to operably engage the upper leg portion of a doll.

A user assembles the bench 36 from the four planar slotted members 42, 44, 44*a*, 44*b*. 46, by aligning the leg members 44*a*, 44*b* with the back member 42 so that slots 62*a*, 62*b* operably engage first slots 48*a*, 48*b* as shown, and then sliding the leg members 44*a*, 44*b* in the direction of arrows 84 (FIG. 11) so that each leg member 44*a*, 44*b* is positioned relative to the back member 42 as shown in FIG. 10. Then, the user aligns the seat member 46 with the back member 42 such that slot 70 aligns with second slot 52, and then slides the seat member 46 in the direction of arrow 85 (FIG. 11) so that the seat member 46 is positioned relative to the back member 42 as shown in FIG. 10. The bench 36 may be easily disassembled by reversing these steps.

With the bench 36 assembled as shown in FIG. 10, a doll may be positioned on each protrusion 74*a*, 74*b* on the seat member 46 in a quasi-standing position. Accordingly, each doll appears to be sitting on the bench with its feet resting on the ground, thereby providing an aesthetically pleasing position for the doll relative to the bench.

E. Bed

Referring to FIGS. 12–14, a bed 38 formed from a plurality of slotted planar members 22 is disclosed. Preferably, the bed includes a substantially planar headboard 130, a substantially planar footboard 132, and a pair of substantially planar running boards 134*a*, 134*b*. The headboard 130 and footboard 132 each include a pair of parallelly-aligned spaced apart slots 136*a*, 136*b* extending to a lower edge 137 of the respective headboard 130 and footboard 132. Each running board 134*a*, 134*b* includes a pair of parallel aligned, spaced apart slots 138*a*, 138*b* extending to an upper edge 140. The slots 136*a*, 136*b* in the headboard 130 and footboard 132 and the slots 138*a*, 138*b* in the running boards are sized and positioned so as to allow the headboard 130 and footboard 132 to be spaced-apart and parallelly aligned with each other, and the running boards 134*a*, 134*b* to be spaced-apart and parallelly aligned with each other, thereby forming a substantially rectangular structure as shown in FIG. 12.

Preferably the running boards 134*a*, 134*b* include rail members 142 extending therefrom so that a bedboard 144 may rest on them as best shown in FIG. 14, thereby defining the sleeping portion of the bed 38.

A user assembles the bed 38 by parallelly aligning the running boards 134*a*, 134*b* as shown in FIG. 13 and aligning the respective slots 136*a*, 136*b* on the headboard 130 and footboard 132 with mating slots 138*a*, 138*b* on the running boards 134*a*, 134*b* as shown. The user then slides the headboard 130 and footboard 132 in the direction of arrows 146 (FIG. 13), and positioning the bedboard 144 on the rail members 142 to form the bed 38. The bed 38 may be easily disassembled by reversing these steps.

F. Table

Referring to FIGS. 15 & 16, a table 40 formed from a plurality of slotted planar members 22 is disclosed. Preferably, the table 40 includes a substantially planar table top member 150 operably secured to four substantially planar leg members 152.

More preferably and as best shown in FIG. 16, the table top member 150 includes a top surface member 154 and a substantially planar leg attachment member 156 parallelly aligned and spaced apart from the top surface member with spacer members 158. The spacer members 158 are positioned to as to cantilever the outer edges 160 of the leg attachment member 156. Each corner of the leg attachment member 156 includes a slot 162 extending to the outer edge corner. Preferably, the leg attachment member 156 is substantially rectangular, and each slot 162 is aligned substantially at a 45 degree angle relative to the outer edges 160 of the leg attachment member 156 as shown in FIG. 16.

Each leg member 152 includes an attachment end 164 and an opposite distal end 166. The attachment end 164 includes a slot 168 extending to an outer edge 170 of the leg and sized to operably engage one slot 162 on the leg attachment member 156. Preferably the edges 172 of the distal ends of the leg members 152 are shaped and contoured so as to make them aesthetically pleasing.

A user assembles the table by aligning the attachment end 166 of each leg member 152 with the corners of the attachment member 156 on the table top member 150 such that each slot 162 on the attachment member aligns with the slot 168 on a leg member 152. The leg member 152 is then urged in the direction of arrow 174 (FIG. 16) so that the slots 162, 168 operably engage each other, thereby securing the leg member 152 to the table top member 150. The table 40 may be easily disassembled by reversing these steps.

In view of the wide variety of embodiments to which the principles of the invention can be applied, it should be apparent that the detailed embodiments are illustrative only and should not be taken as limiting the scope of the invention. For example the seat backs in the chair and bench embodiments need not extend substantially above the second slot. In such case, the fully assembled chair or bench would appear "backless," but would still function as described.

Also, surface ornamentation on the planar members may be applied by the manufacturer, or by the user. In the latter case, the articles of furniture may be sold as a craft kit, wherein the user can customize their furniture by decorating it themselves.

Accordingly, the claimed invention includes all such modifications as may come within the scope of the following claims and equivalents thereto.

I claim:

1. A chair formed by the joining of three substantially planar members together, said chair comprising:

a first substantially planar member having a first elongate slot and a second elongate slot therein, said first substantially planar member having a first outer edge and said first and second slots spaced apart from each other, aligned substantially perpendicular to each other, and extending to said first outer edge;

a second substantially planar member having a second outer edge and said second substantially planar member having a third substantially elongate slot extending to said second outer edge; and, a third substantially planar member having a third outer edge and said third substantially planar member having a fourth substantially elongate slot extending to said third outer edge;

said second substantially planar member aligned substantially perpendicular to said first substantially planar member such that said first elongate slot and said third elongate slot operably engage each other thereby securing said first and second substantially planar members together so that said second substantially planar member is positioned substantially horizontally to define a seat of the chair;

said third substantially planar member aligned substantially perpendicular to said first substantially planar member and perpendicular to said second substantially planar member such that said second elongate slot and said third elongate slot operably engage each other thereby securing said first and third substantially planar members together so that said first and third substantially planer members define legs of the chair.

2. The chair of claim 1, wherein said first and second substantially planar members are detachably secured together.

3. The chair of claim 2, wherein said first and third substantially planar members are detachably secured together.

4. The chair of claim 1, wherein said first, second, and third substantially planar members have unfinished surfaces thereby defining a craft kit.

5. The chair of claim 1, wherein said chair is sized to support a doll, said doll having a rear end with a pair of doll legs extending therefrom.

6. The chair of claim 5, wherein said seat includes a protrusion extending therefrom, said protrusion sized to operably engage the rear end of the doll while the pair of doll legs straddle the protrusion.

7. The chair of claim 6, wherein said protrusion is smoothly arcuate.

8. The chair of claim 6, wherein said protrusion includes a pair of concave recesses adjacent to and straddling said protrusion for operably engaging a leg of the pair of doll legs.

9. The chair of claim 1, wherein said first substantially planar member includes a back portion and a first leg portion of the chair, and said third substantially planar member defines a second leg portion of the chair.

10. The chair of claim 9, wherein said first and third substantially planar members are aligned substantially vertically.

* * * * *